US011676432B2

(12) United States Patent
Ljung et al.

(10) Patent No.: US 11,676,432 B2
(45) Date of Patent: Jun. 13, 2023

(54) ELECTRONIC DEVICE, AN ACCESS CONTROL DEVICE, AND RELATED METHODS

(71) Applicants: Sony Corporation, Tokyo (JP); Sony Network Communications Europe B.V., Hoofddorp (NL)

(72) Inventors: Rickard Ljung, Helsingborg (SE); Carl-Johan Weiderstrand, Lomma (SE)

(73) Assignee: Sony Group Corporation, Tokyo (JP)

( * ) Notice: Subject to any disclaimer, the term of this patent is extended or adjusted under 35 U.S.C. 154(b) by 0 days.

(21) Appl. No.: 17/197,414

(22) Filed: Mar. 10, 2021

(65) Prior Publication Data

US 2021/0295625 A1 Sep. 23, 2021

(30) Foreign Application Priority Data

Mar. 17, 2020 (SE) ..... 2050292-8

(51) Int. Cl.
*G07C 9/00* (2020.01)

(52) U.S. Cl.
CPC ..... *G07C 9/00309* (2013.01); *G07C 2009/00373* (2013.01); *G07C 2009/00523* (2013.01); *G07C 2009/00769* (2013.01); *G07C 2209/64* (2013.01)

(58) Field of Classification Search
CPC ..... G07C 9/00309; G07C 2209/63; G07C 2009/64
See application file for complete search history.

(56) References Cited

U.S. PATENT DOCUMENTS

| | | | | |
|---|---|---|---|---|
| 9,328,533 | B2 | 5/2016 | Wu | |
| 10,389,987 | B2 * | 8/2019 | Irani | H04N 7/186 |
| 11,295,563 | B2 * | 4/2022 | Kuenzi | G07C 9/28 |
| 11,381,676 | B2 * | 7/2022 | Arellano | G06F 1/1626 |
| 2001/0054952 | A1 | 12/2001 | Desai | |
| 2012/0280789 | A1 | 11/2012 | Gerhardt et al. | |
| 2013/0176107 | A1 | 7/2013 | Dumas et al. | |
| 2015/0206365 | A1 | 7/2015 | Wu | |
| 2016/0189454 | A1 | 6/2016 | Johnson | |
| 2016/0353239 | A1 | 12/2016 | Kjellsson | |
| 2019/0295349 | A1 | 9/2019 | Kim | |

(Continued)

FOREIGN PATENT DOCUMENTS

| | | | |
|---|---|---|---|
| CN | 109151012 | A | 1/2019 |
| EP | 3147868 | A1 | 3/2017 |
| EP | 3496054 | A1 | 6/2019 |

(Continued)

OTHER PUBLICATIONS

Swedish Office Action with Search Report from corresponding Swedish Application No. 2050292-8, dated Feb. 12, 2021, 12 pages.

*Primary Examiner* — Daniell L Negron
(74) *Attorney, Agent, or Firm* — Tucker Ellis LLP

(57) ABSTRACT

An electronic device includes a memory circuitry, an interface circuitry, and a processor circuitry. The processor circuitry is configured to determine prioritization data associated with the one or more access control devices. The processor circuitry is configured to control, based on the prioritization data, at least one of the one or more access control devices.

17 Claims, 6 Drawing Sheets

(56) References Cited

U.S. PATENT DOCUMENTS

2021/0084494 A1* 3/2021 Angelov ..... H04W 12/08

FOREIGN PATENT DOCUMENTS

| | | | |
|---|---|---|---|
| WO | 2017008622 | A1 | 1/2017 |
| WO | 2017180388 | A1 | 10/2017 |
| WO | 2018048956 | A1 | 3/2018 |
| WO | 2019160250 | A1 | 8/2019 |
| WO | 2019201933 | A1 | 10/2019 |
| WO | 2019245832 | A1 | 12/2019 |

* cited by examiner

ELECTRONIC DEVICE, AN ACCESS CONTROL DEVICE, AND RELATED METHODS

RELATED APPLICATION DATA

This application claims the benefit of Swedish Patent Application No. 2050292-8 filed on Mar. 17, 2020, the disclosure of which is incorporated herein by reference in its entirety.

TECHNICAL FIELD

The present disclosure pertains to the field of Internet of things and remote-controlled access systems. The present disclosure relates to an electronic device, an access control device and to methods for controlling one or more access control devices and methods for controlling access to a space.

BACKGROUND

There are many scenarios where electronic devices (such as smartphones, and Internet of things, IoT, devices) are used in remote controlled access systems for controlling the access to a space (such as by locking and unlocking of an access control device, for example locking and unlocking of a door).

SUMMARY

Operation of remote-controlled access systems may be executed in a two-step approach where an electronic device (such as a wirelessly connected device, for example a smartphone or similar) is configured to control an access control device (such as a door-lock or similar). The first step comprises to detect the access control device wirelessly with the electronic device by communicating with the access control device. The second step comprises to control the access control device with the electronic device.

However, the complexity of the operations in a remote-controlled access system may be challenging. The operations often involve many steps, which may be complex. Further, it may be challenging in remote-controlled access systems to control the intended access control device with an electronic device (for example when a plurality of access control devices are in the same area).

Further, it may be challenging to ensure a secure operation of remote-controlled access systems so that access is remotely granted to the intended access control device in a manner that is robust against an attacker trying to obtain unauthorized access by being judiciously placed. For example, it may be challenging to determine a position of a user carrying an electronic device with respect to the access control device to be controlled (for example locked or unlocked). For example, it may be challenging to determine whether the user is positioned on the outside of a space to be unlocked or on the inside of the space to be unlocked. For example, an attacker may be placed on the outside of a space, while a legitimate party may be placed on the inside of the space.

Power optimization is also a challenging aspect of electronic devices and/or access control devices such as connected devices and IoT, devices. It may be challenging to reduce energy consumption of electronic devices and/or access control devices for example to ensure that a battery powered electronic device and/or access control device may be working for its intended operation time.

Accordingly, there is a need for electronic devices, access control devices, methods for controlling one or more access control devices, and methods for controlling access to a space which mitigate, alleviate or address the shortcomings existing and provide an improved remote-controlled access system with reduced complexity, enhanced security, and power efficiency.

The present disclosure provides an electronic device. The electronic device comprises a memory circuitry, an interface circuitry, and a processor circuitry. The processor circuitry is configured to determine prioritization data associated with the one or more access control devices. The processor circuitry is configured to control, based on the prioritization data, at least one of the one or more access control devices.

Further, a method, performed by an electronic device, for controlling one or more access control devices, is provided. The method comprises determining prioritization data associated with the one or more access control devices.

The method comprises controlling based on the prioritization data, at least one of the one or more access control devices.

Further, an access control device is provided. The access control device comprises a memory circuitry, an interface circuitry, and a processor circuitry. The processor circuitry is configured to detect an activation of the access control device. The processor circuitry is configured to transmit an activation signal to an electronic device based on the detected activation. The processor circuitry is configured to receive, from the electronic device, an access control command.

Further, a method, performed by an access control device, for controlling access to a space, is provided. The method comprises detecting an activation of the access control device. The method comprises transmitting an activation signal to an electronic device based on the detected activation. The method comprises receiving from the electronic device, an access control command.

It is an advantage of the present disclosure that the complexity of the operations in a remote-controlled access system may be reduced. This may be achieved by determining prioritization data associated with the one or more access control devices, which in turn may reduce the number of operation steps to be performed (such as reducing the number of steps to be performed by a user for unlocking an intended door). An advantage may be that the access control device that a user intends to control may be targeted, and not another nearby access control device.

Further, an advantage is that the security of the operation of remote-controlled access systems may be improved. This may be achieved by determining at least one proximity parameter related to a difference in physical locations between the electronic device and at least one or more access control devices (for example for determining a position of a user carrying an electronic device with respect to the access control device to be controlled, such as locked or unlocked). This may, for example, give information on whether a user is positioned on the outside of a space to be unlocked or on the inside of the space to be unlocked.

A further advantage of the present disclosure is that power optimization is also a challenging aspect of access control devices, such as connected devices and IoT, devices. It may be challenging to reduce energy consumption of electronic devices and/or access control devices for example to ensure that a battery powered access control device may be working for its intended operation time.

The above advantages may provide an improved operation of remote-controlled access systems with reduced power consumption (such as minimized and/or decreased power consumption or power usage), while keeping a reliable and secure access control.

It is an advantage of the present disclosure that the power consumption of the electronic device and/or of the access control device may be reduced. This may be achieved by optimizing the control of the one or more access control devices, based on the determined prioritization data, such as to reduce unnecessary communication with unintended access control devices.

BRIEF DESCRIPTION OF THE DRAWINGS

The above and other features and advantages of the present disclosure will become readily apparent to those skilled in the art by the following detailed description of example embodiments thereof with reference to the attached drawings, in which.

DETAILED DESCRIPTION

Figure 1A:
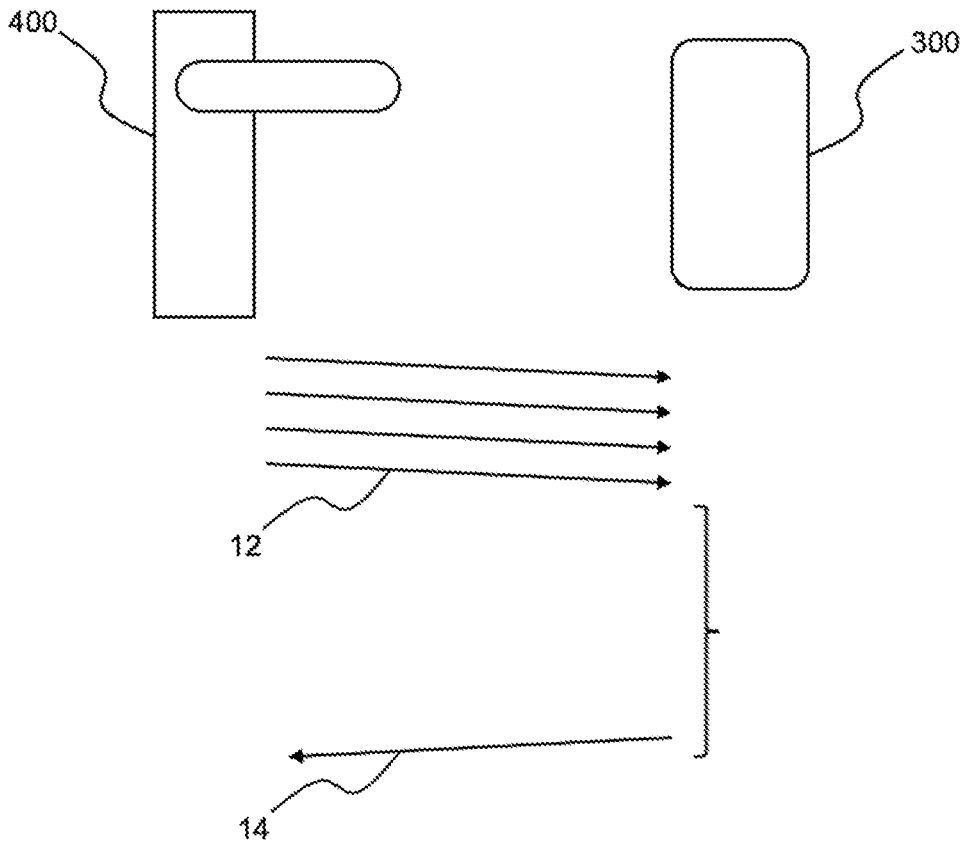
FIG. 1A is a schematic representation illustrating an example of a scenario for controlling one or more access control devices and for controlling access to a space.

Various example embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the disclosure or as a limitation on the scope of the disclosure. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The figures are schematic and simplified for clarity, and they merely show details which aid understanding the disclosure, while other details have been left out. Throughout, the same reference numerals are used for identical or corresponding parts.

FIG. 1A is a schematic representation illustrating an example of a scenario for controlling one or more access control devices and for controlling access to a space. FIG. 1A shows an electronic device 300 and an access control device 400.

The electronic device 300 may be seen as a wireless connectivity device configured to run a software having an access control program (such as an application software) to control or handle the access system.

The access control device 400 may be a device configured to control access (such as to authorize or not, lock or unlock) to a space, such as room, a box, a floor, and/or an area.

Example environments to apply the disclosure may include hospitals, industrial areas, medicine lockers, building, The access control device 400 may be for example a lock device, such as a Bluetooth-enabled lock. The access control device 400 may for example transmit a message, such as a Bluetooth message, to a surrounding area, for example with a periodicity.

The example access system illustrated in FIG. 1A shows a two-step approach controlled by the electronic device 300. In a first step, the access control device 400 is detected wirelessly by the said application in the electronic device 300, for example via information or message(s) 12 sent from the access control device 400 to the electronic device 300 over a local and/or wireless connectivity technology, such as Bluetooth or Ultra Wideband.

The message 12 is received by the electronic device 300, for example with a right to decode and read the message. Depending on settings of the access control device 400, the electronic device 300 may be able to discover the access control device 400 and send a command 14 (for example via the application) to the access control device 400, so as to control the access control device (such as lock/unlock). In a second step, the application in the electronic device 300 identifies/authorizes the access control device 400 and sends a command 14 (e.g. lock/unlock command) as the remote control command. The command 14 may also be sent over same local and/or wireless connectivity solution.

In some applications, the access control device can receive a command to unlock as the electronic device has detected the access control device.

In order to execute the second step in an electronic device, a user managing the electronic device needs to perform multiple steps to activate the specific application running in the electronic device 300 for the access system management.

The operations may involve many steps, which may be complex, for example with a smartphone:

1. Touch an on/off button, a fingerprint reader or perform a similar action to activate the smartphone screen.
   If a fingerprint reader was not used in step 1: Authenticate the user, e.g. enter a PIN code, enter a lock screen pattern.
2. Identify an icon or similar for the application in question and click to open the application.
3. Click on a lock/unlock command within the application.
4. Shut down the phone screen by touching the on/off button or similar.

Figure 1B:
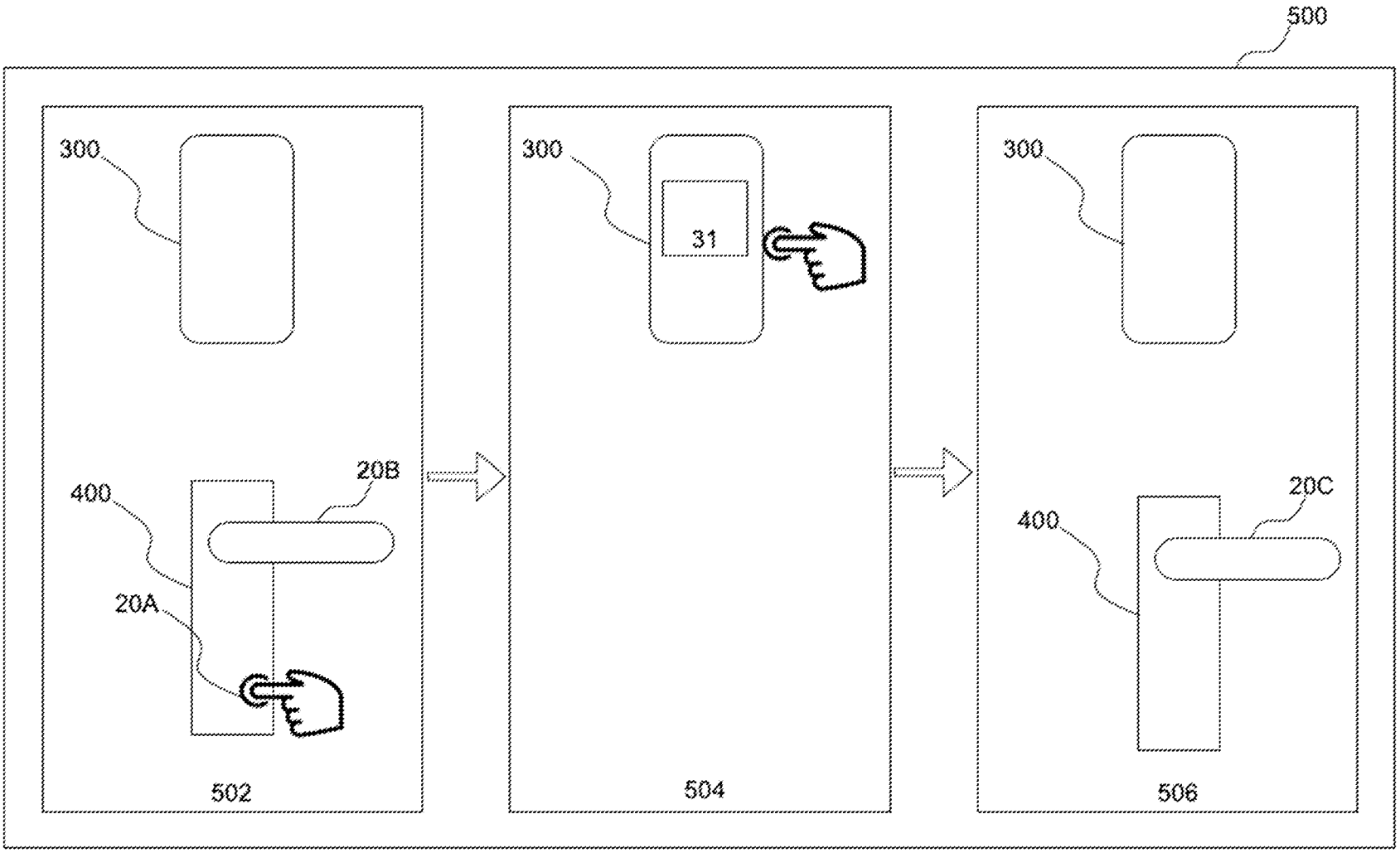
FIG. 1B is a schematic representation illustrating an example scenario for controlling one or more access control devices and for controlling access to a space according to one or more embodiments of this disclosure.

FIG. 1B is a schematic representation 500 illustrating an example scenario for controlling one or more access control devices and for controlling access to a space according to one or more embodiments of this disclosure (such as for lock management). FIG. 1B shows an electronic device 300 and an access control device 400 according to this disclosure.

The electronic device 300 may be seen as a device configured to run a software having an access control program (such as an application software) to control or handle the access system (such as a smartphone or similar). The electronic device 300 may be a wireless device in some embodiments.

The electronic device 300 may be seen as a wireless connectivity device configured to run a software having an access control program (such as an application software) to control or handle the access system (such as a smartphone or similar).

The access control device 400 may be a device configured to control access (such as to authorize or not, lock or unlock) to a space, such as room, a box, a floor, and/or an area.

The access control device 400 may be for example a wireless access control device.

The access control device 400 may be for example a lock device, such as a Bluetooth-enabled lock. The access control device 400 may for example transmit a message, such as a Bluetooth message, to a surrounding area, for example with a periodicity.

The example access system illustrated in FIG. 1B shows a three step approach controlled by the electronic device 300. In a first step 502 the access control device 400 detects an activation of the access control device 400. The activation may for example be an activation button 20A comprised in the access control device 400, such that a user may activate the access control device 400 by pushing the activation button 20A. Optionally, the activation of the access control device may be done by pushing or pressing down the handle 20B of the access control device 400. The access control device then transmits an activation signal to the electronic device 300 based on the detected activation. In other words, a coupling between the access control device 400 (such as with a lock activation push, for example the push of a button located on the lock) with the electronic device 300 (such as smartphone application). In a second step 504 the electronic device 300 receives an activation signal from the access control device 400. In other words, the electronic device 300 receives an activation signal that may be shown on a user interface 31 of the electronic device (such as showing a message on a locked screen). The user may therefore not need to unlock the electronic device (such as unlock the screen of a smartphone). The user of the electronic device 300 may then control the access control device 400 using the user interface 31 of the electronic device 300 (also without the need for unlocking the electronic device 300). In other words, the user may immediately at the reception of the activation signal (such as a lock screen event) have the capability of controlling (such as performing a control command) to the access control device (such as a lock) without unlocking the electronic device (such as without unlocking a smartphone). In other words, the user may authenticate himself for controlling (such as locking and/or unlocking) the access control device 400. Optionally, the user may control the access control device by pushing or pressing down the handle 20C of the access control device 400.

For example, when the activation signal (such as a Bluetooth message) is received by the electronic device (such as smartphone) and the access control program (such as application software) has determined prioritization data of the access control device (such as executed an authentication of the access control device, such as a lock), the electronic device (such as smartphone) provides via the user interface 31 (for example via screen and touch sensor and/or fingerprint sensor) a function to determine prioritization data (such as execute a user authentication) and controls the access control device (such as with a lock control command) while otherwise having the electronic device (such as smartphone) still in a locked state (such as in its lock-screen mode).

Optionally, this functionality may be achieved as follows. The access control program (such as application software) may be running in an operating system of the electronic device (such as running on a mobile phone) and is provided access to perform background scanning using the local connectivity of the electronic device. When the access control device (such as access system) is detected (such as discovered and identified), the electronic device (such as the operating system of the electronic device) may allow the access control program to determine the prioritization data (such as lock-screen functionality of user authentication) and to control the access control device (such as lock control command).

In order to avoid unauthorized access in cases where many access control devices (such as locks) are close, the closest access control device is to have priority within the access control system, such as the electronic device. For example, when an attacker is waiting by an access control device (such as a lock) until a user with granted access arrives at a access control device (such as lock) close enough to have radio connection to both access control devices (such as locks). The attacker may press the button and the user would unintentionally open the attackers access control device (such as lock). The present disclosure allows preventing this scenario by a prioritization to manage intended access control devices (such as locks) only.

Figure 2:
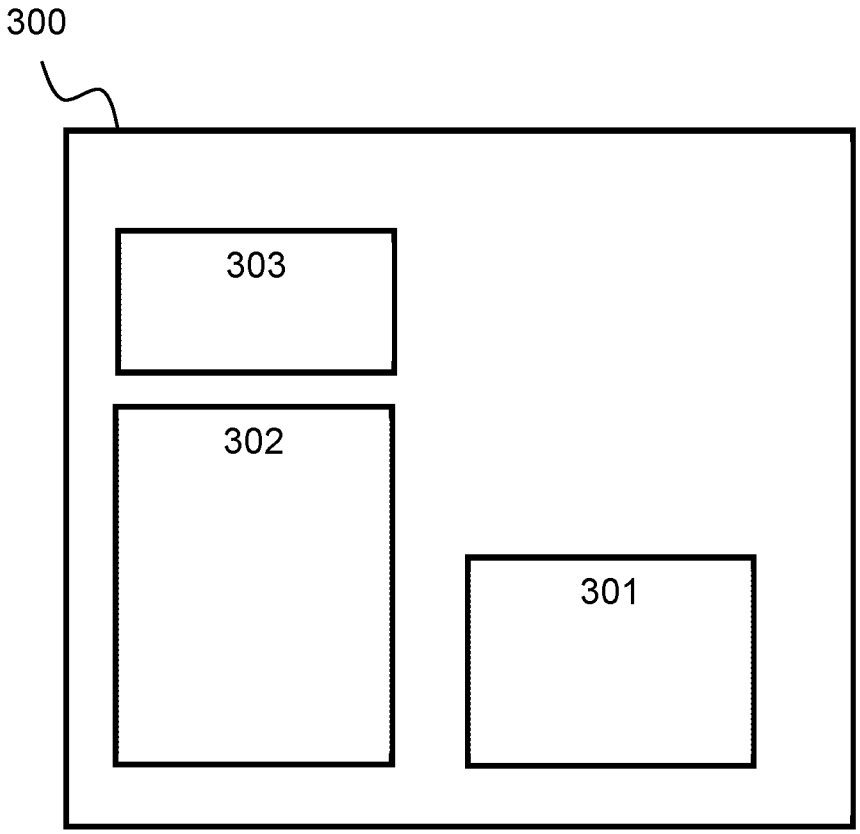
FIG. 2 is a block diagram illustrating an example electronic device according to this disclosure.

The present disclosure proposes solutions for how to determine such prioritization of the likely closest access control device or by other means the most likely access control devices to be controlled. The disclosed technique permits achieving an improved accuracy of the access control. FIG. 2 is a block diagram illustrating an example electronic device 300 according to some embodiments of the present disclosure.

The electronic device 300 comprises a memory circuitry 301, an interface circuitry 303, and a processor circuitry 302. The electronic device 300 may for example be a portable electronic device, such as a smartphone, an IoT device, a remote control, and/or a remote key. The interface circuitry 303 may be configured for wired communication and/or wireless communication.

The processor circuitry 302 is configured to determine prioritization data associated with the one or more access control devices (such as indicative of a prioritizing of a nearest located access control device, for example a nearest located lock). In other words, to determine prioritization data associated with the one or more access control devices may comprise to determine a prioritization of one or more access control devices for a remote-controlled access system.

The prioritization data may be indicative of an order of priority of the one or more access control devices. The order of priority may be based on proximity between the electronic device and the one or more access control devices detected. The prioritization data may comprise, for some or all of the one or more access control devices, one or more of: an access control device identifier, and a proximity parameter. Prioritization data may comprise information related to whether the one or more access control device have been controlled before. The prioritization data may comprise access control device ID information, access control device type information or similar, (such as to enable to determine prioritization to be made based on such information). Further, the prioritization data may comprise radio communication related parameters. The prioritization data may comprise information related to the relative angular direction of a signal communicated between the access control device and the electronic device and/or related to the signal strength of a signal communicated between the access control device and/or electronic device. The prioritization data may comprise information related to time, for example:

the time of latest control (such as latest management and/or latest activation) and/or time of general management of the device and/or the time of activation of radio signal based detection signal transmissions. Further, the prioritization data may comprise information on the type of radio based signal detected (such as in the event of multiple radio transmission technologies are supported). Further, the prioritization data may relate to historical usage patterns, enabling a higher priority to a device that often is managed at the specific time of day or day in week or similar based on a historical usage pattern.

The processor circuitry 302 is configured to control, based on the prioritization data, at least one of the one or more access control devices. In other words, processor circuitry 302 is configured to control, based on the prioritization data, at least one of the one or more access control devices, e.g. to determine which access control device(s) is to be controlled.

To control, based on the prioritization data, at least one of the one or more access control devices may comprise to provide an access control command causing the at least of the one or more access control devices to provide or deny access (such as to lock or unlock a lock, a door, a casing, a vehicle lock etc.) to a requester.

In other words, to control, based on the prioritization data, at least one of the one or more access control devices may comprise to enable a prioritization for a remote-controlled access system, such as to identify and define a priority to get the management of the one or more access control devices (such as of one or more locks) which is/are closest to for example the user carrying the electronic device.

In one or more example electronic devices, the electronic device 300 is configured to receive (such as with the processor circuitry 302) a signal from at least one of the one or more access control devices, and to determine prioritization data associated with the one or more access control devices based on the signal.

In one or more example electronic devices, the processor circuitry 302 is configured to determine at least one proximity parameter, optionally related to a difference in physical locations between the electronic device and at least one of the one or more access control devices.

In other words, the processor circuitry may be configured to determine at least one proximity parameter indicative of a physical position of the at least one access control device with respect to the electronic device.

The at least one proximity parameter may for example comprise a distance between the electronic device and at least one of the one or more access control devices and/or an angular parameter (such as an angular difference between the electronic device and at least one of the one or more access control devices) indicative of a difference in physical locations.

In one or more example electronic devices, the processor circuitry 302 is configured to determine at least one proximity parameter between the electronic device and at least one of the one or more access control devices.

In one or more example electronic devices, the processor circuitry 302 is configured to determine the prioritization data associated with the one or more access control devices based on the determined at least one proximity parameter. In other words, the processor circuitry may be configured to determine one or more access control devices to be controlled based on which one or more access control devices are the nearest to the electronic device.

In one or more example electronic devices, the processor circuitry 302 is configured to determine the at least one proximity parameter based on a wireless measurement parameter of an activation signal (such as a detection signal, and/or a discovery signal, such as signal 12 of FIG. 1A) received from the at least one of the one or more access control devices.

In one or more example electronic devices, the wireless measurement parameter comprises one or more of: a received activation signal strength parameter, an activation signal quality parameter, an angular measurement parameter, and a time of arrival parameter. The wireless measurement parameter may comprise a received signal strength indication, RSSI, a signal to noise ratio, SNR, and/or a signal to interference plus noise ratio, SINR.

For example, a ranging and thereby prioritization can be achieved with signal strength measurements of a radio signal transmitted by the access control device(s) or the electronic device, such as a wearable device For example, the access control device can implements a receiver which is activated upon a sensor being trigger or a press of a button associated with the access control device.

In one or more example electronic devices, the activation signal received from the at least one of the one or more access control devices for the wireless measurement parameter is received using a short-range wireless communication system and/or an optical communication system.

For example, the activation signal received from the at least one of the one or more access control device for the wireless measurement parameter may be received using a short-range wireless communication system such as Ultra WideBand, UWB, Bluetooth, and/or directional radio signal transmissions (such as by use of so-called beamforming). For example, when transmitting simultaneously with two or more antenna elements using different transmission phases, the activation signal may be transmitted having a main signal strength peak oriented in a determined direction.

The radio signal may be a short range communication signal such as Ultra-wideband ranging or Bluetooth, and the receiver may determine the signal strength (received signal energy) and/or signal quality (signal strength over interference and/or noise) level measurements For example, a ranging and thereby prioritization may be achieved using angular measurements and restrictions between the access control device and the electronic device (for example the user has to stand in front of the lock). This can for example be achieved using directional radio signal transmissions e.g. by use of so-called beamforming.

In one or more embodiments, the activation signal may be received using an optical communication system (such as an optical sensing functionality). For example, the access control device and/or the electronic device may comprise a sensor (such as a light sensor, for example an infrared, IR, sensor), and the electronic device (for example comprising a wearable device) may comprise a transmitter for transmitting an optical signal (such as a light signal) and/or a receiver for receiving an optical signal. The reception and/or detection of the light signal from the transmitter may be indicative of the activation signal.

In one or more embodiments, the electronic device may be configured to transmit an activation request to the one or more access control devices, and to receive an activation signal from the one or more access control devices.

In one or more embodiments, the activation signal may be received using an optical communication system such as a camera. For example, the camera-based sensing may be used to determine the type and/or model of the access control device (such as type and/or model of lock), for example by using image recognition (such as detection of a barcode, QR-code, an image of the access control device, representation of the access control device or the like) to recognise the access control device.

In one or more example electronic devices, the processor circuitry 302 is configured to obtain permission data associated with the at least one of the one or more access control devices.

For example, with the usage of determination or characteristics of the detected information (e.g. the type of lock, a bar code detected by the camera, a specific sequence ID transmitted using the radio signal described earlier), there may be permission data, such as a permission set within the prioritization function. Hence, with such permission, only certain locks within the proximity can be allowed to be used, even if detected as being close to the mobile device.

In one or more example electronic devices, the processor circuitry 302 is configured to determine the prioritization data associated with the one or more access control devices based on the permission data obtained. Permission data may for example comprise data related to one or more permissions that the electronic device has for controlling the one or more access control devices. In other words, in some embodiments the electronic device may only control the one or more access control device if the electronic device comprise the permission data required for controlling the one or more access control devices. The permission data may comprise one or more of: access rights associated with a requester of access, a user identifier, a key exchange, a time parameter, and/or a vendor identifier.

The permission data may be stored on the memory circuitry 301.

Permission data may for example comprise one or more digital keys, such as encrypted keys for controlling the one or more access control devices.

In one or more example electronic devices, the processor circuitry 302 is configured to determine a pattern associated with the at least one of the one or more access control devices.

To determine a pattern associated with the at least one of the one or more access control devices may comprise to determine a logical pattern that is based for example on a routine (such as a routine of a user carrying the electronic device, for example leaving or coming home at specific hours, opening or locking an access control device at certain hours, after a certain time, and/or after having been at a certain location) and/or in a building (such as the electronic device passing by a certain number of doors, passing by specific doors, and/or a controlling a series of access control devices. An example scenario may be that a user goes to his car after leaving his house, and the other way around unlocks his house after leaving his car. Another example scenario could be in a building, such as a hospital, where a series of doors unlocked after each other by a doctor or a nurse, for example unlocking door 1, then door 2, and then door 3 in the same order every time.

In one or more example electronic devices, the processor circuitry 302 is configured to determine the prioritization data associated with the one or more access control devices based on the determined pattern. For example, the prioritization data may be determined based on a routine and/or in a building, such as in the example scenarios described above.

In one or more example electronic devices, the processor circuitry 302 is configured to detect the one or more access control devices.

To detect the one or more access control devices may comprise to detect one or more transmitted signals from the one or more access control devices (such as one or more transmitted discovery signals, for example via information sent from the one or more access control devices to the electronic device such as via a local connectivity technology such as Bluetooth or UWB). In some embodiments, the detection of the one or more access control devices may be done by using a short-range wireless communication system and/or an optical communication system.

In one or more example electronic devices, the processor circuitry 302 is configured to determine whether there is a new access control device amongst the one or more detected access control devices.

In one or more example electronic devices, the processor circuitry 302 is configured to add the new access control device to a storage of the electronic device (such as adding or storing the newly detected access control device to the memory circuitry 301, for example to a list of known access control devices) when it is determined that there is a new access control device amongst the one or more detected access control devices.

In one or more example electronic devices, the processor circuitry 302 is configured to stop and/or pause a detection procedure when it is not determined that there is a new access control device amongst the one or more detected access control devices.

The disclosed electronic device provides in one or more embodiment a user interface comprising a user interface object indicative of the prioritization data, so that the user may be presented with the prioritized list and can select another one of the detected and permitted access control devices.

Figure 3:
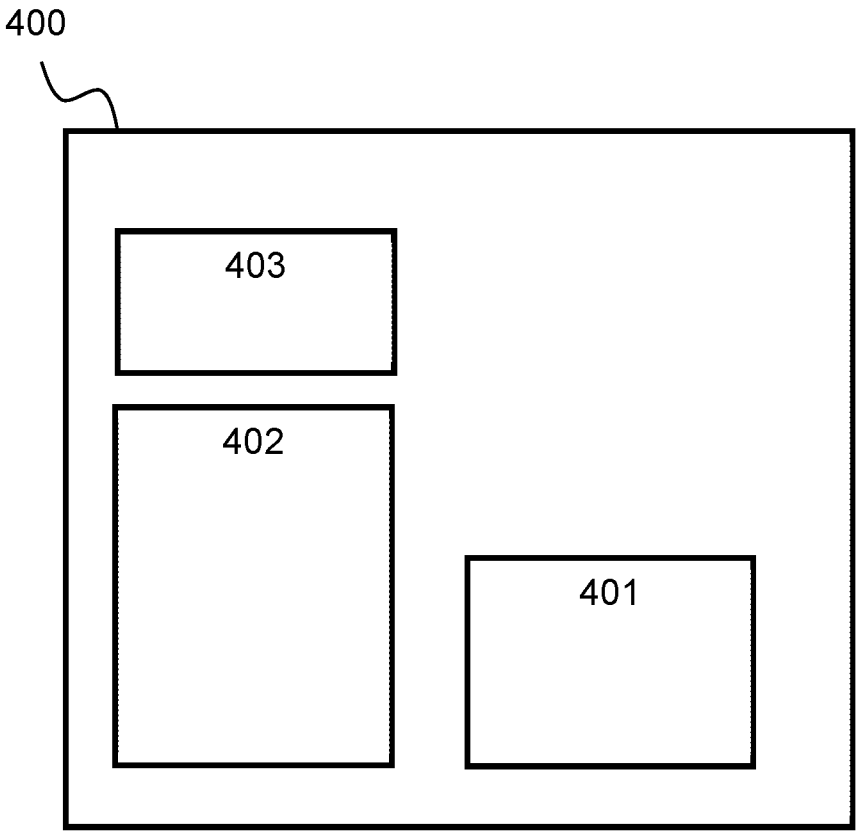
FIG. 3 is a block diagram illustrating an example access control device according to this disclosure.

FIG. 3 is a block diagram illustrating an example access control device 400 according to some embodiments of the present disclosure.

The access control device 400 comprises a memory circuitry 401, an interface circuitry 403, and a processor circuitry 402. The interface circuitry 403 may be configured for wired communication and/or wireless communication.

In one or more example access control devices, the access control device may comprise a device comprising a locking mechanism such as an automated locking mechanism for locking, unlocking, granting, providing access, denying access, closing, and/or opening, a manual opening mechanism such as a handle for example a door handle, a safety box such as a locker, a detection mechanism such as for detecting signals from a short-range wireless communication system and/or an optical communication system.

The processor circuitry 402 is configured to detect an activation of the access control device (for example by receiving an activation request, for example from the electronic device, and/or an activation button collocated with the access control device).

The processor circuitry 402 is configured to transmit an activation signal to an electronic device 300 based on the detected activation.

The processor circuitry 402 is configured to receive, from the electronic device 300, an access control command. The access control command may be sent, by the electronic device 300, based on prioritization data determined by the electronic device 300.

In one or more example access control devices, the processor circuitry 402 is configured to detect the activation using a sensor device and/or an activation button.

For example, the processor circuitry 402 is configured to detect the activation using a sensor device such as a touch sensor, a microphone (for example for voice command activation), an iris sensor, and/or a camera (for example for face recognition).

In one or more example access control devices, the access control device is configured to transmit the activation signal to the electronic device using a short-range wireless communication system and/or an optical communication system.

For example, the activation signal may be transmitted using a short-range wireless communication system such as Ultra Wideband, UWB, Bluetooth, and/or directional radio signal transmissions (such as by use of so-called beamforming). For example, when transmitting simultaneously with two or more antenna elements using different transmission phases, the activation signal may be transmitted having a main signal strength peak oriented in a determined direction.

In some embodiments, the activation signal may be transmitted using an optical communication system (such as an optical transmitting functionality). For example, the access control device and/or the electronic device may comprise a sensor (such as a light sensor, for example an infrared, IR, sensor), and the electronic device (for example comprising a wearable device) and/or the access control device may comprise a transmitter for transmitting an optical signal (such as a light signal). The transmission of the light signal from the transmitter may be indicative of the activation signal.

In one or more embodiments, the access control device may be configured to receive an activation request from the electronic device, and to transmit an activation signal to the electronic device.

In one or more embodiments, the access control device may be configured to transmit an activation signal to the electronic device without having received an activation request.

In some embodiments, the activation signal may be transmitted using an optical communication system such as an infrared transmitter and/or a laser. For example, the activation signal may be used to determine the type and/or model of the access control device (such as type and/or model of lock) by recognising the access control device.

Figure 4:
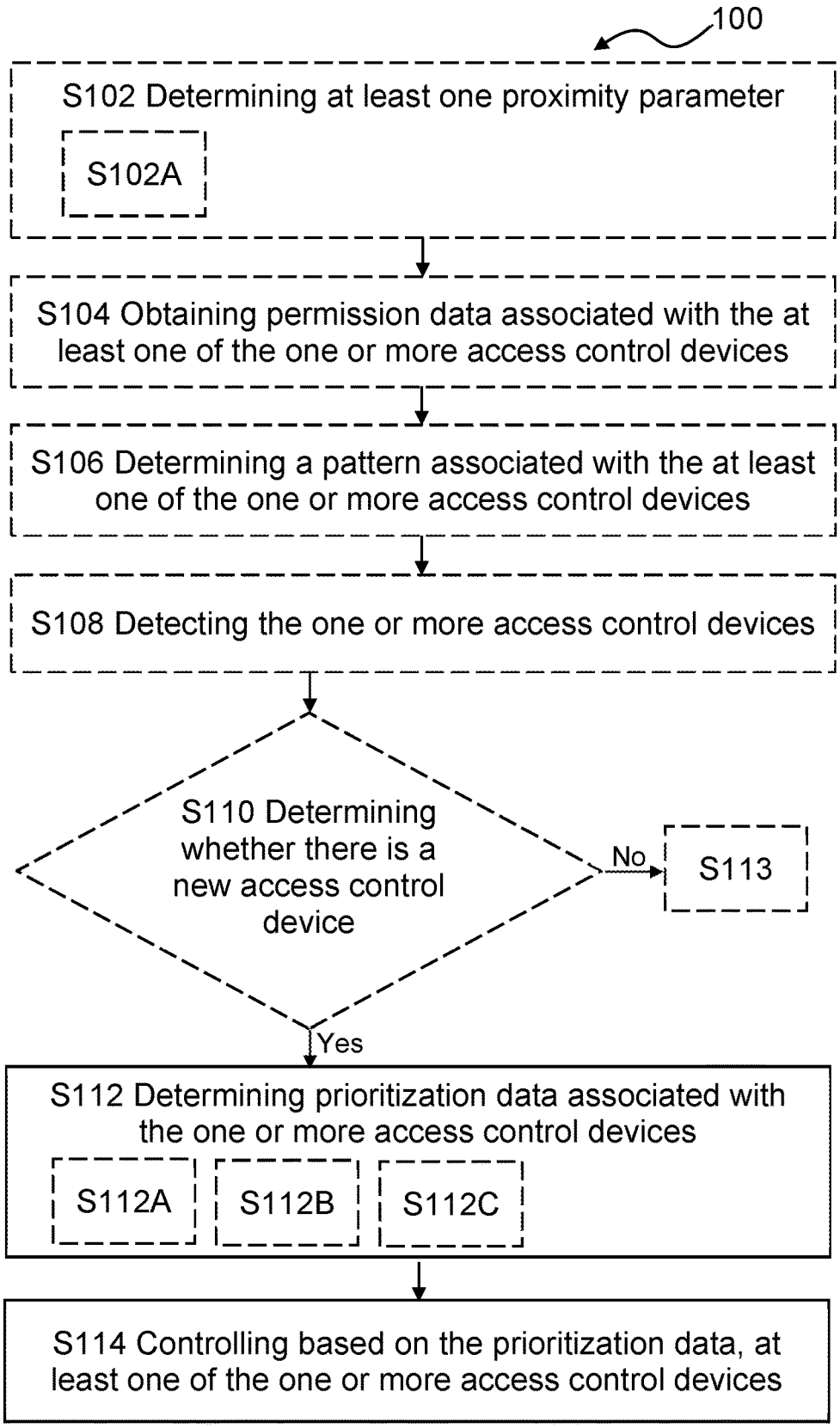
FIG. 4 is a flow-chart illustrating an example method, performed by an electronic device, for controlling one or more access control devices according to this disclosure.

FIG. 4 shows a flow-chart illustrating an example method 100 performed by an electronic device (such as the electronic device disclosed herein, such as the electronic device 300 of FIG. 2), for controlling one or more access control devices (such as the one or more access control devices disclosed herein, such as the one or more access control devices 400 of FIGS. 1A-B and 3).

The method 100 comprises determining S112 prioritization data associated with the one or more access control devices. In other words, to determine prioritization data associated with the one or more access control devices may comprise to determine a prioritization of one or more access control devices for a remote-controlled access system.

The prioritization data may be indicative of an order of priority of the one or more access control devices. The order of priority may be based on proximity between the electronic device and the one or more access control devices detected. The prioritization data may comprise, for some or all of the one or more access control devices, one or more of: an access control device identifier, and a proximity parameter. Prioritization data may comprise information related to whether the one or more access control device have been controlled before. The prioritization data may comprise access control device ID information, access control device type information or similar, (such as to enable to determine prioritization to be made based on such information). Further, the prioritization data may comprise radio communication related parameters. The prioritization data may comprise information related to the relative angular direction of a signal communicated between the access control device and the electronic device and/or related to the signal strength of a signal communicated between the access control device and/or electronic device. The prioritization data may comprise information related to time, for example: the time of latest control (such as latest management and/or latest activation) and/or time of general management of the device and/or the time of activation of radio signal based detection signal transmissions. Further, the prioritization data may comprise information on the type of radio based signal detected (such as in the event of multiple radio transmission technologies are supported). Further, the prioritization data may relate to historical usage patterns, enabling a higher priority to a device that often is managed at the specific time of day or day in week or similar based on a historical usage pattern.

The method 100 comprises controlling S114 based on the prioritization data, at least one of the one or more access control devices.

In one or more example methods, the method 100 comprises determining S102 at least one proximity parameter related to a difference in physical locations between the electronic device and at least one of the one or more access control devices.

In one or more example methods, the method comprises determining S112 prioritization data associated with the one or more access control devices comprises determining S112A the prioritization data associated with the one or more access control devices based on the determined at least one proximity parameter.

In one or more example methods, the method 100 comprises determining S102 at least one proximity parameter related to a difference in physical locations between the electronic device and at least one of the one or more access control devices comprises determining S102A the proximity parameter based on a wireless measurement parameter of an activation signal received from the at least one of the one or more access control devices.

In one or more example methods, the wireless measurement parameter comprises one or more of: a received activation signal strength parameter, an activation signal quality parameter, an angular measurement parameter, and a time of arrival parameter.

In one or more example methods, the activation signal received from the at least one of the one or more access control device for the wireless measurement parameter is received using a short-range wireless communication system and/or an optical communication system.

In one or more example methods, the method 100 comprises obtaining S104 permission data associated with the at least one of the one or more access control devices.

In one or more example methods, the method comprises determining S112 prioritization data associated with the one or more access control devices comprises determining S112B the prioritization data of the one or more access control devices based on the permission data obtained.

In one or more example methods, the method 100 comprises determining S106 a pattern associated with the at least one of the one or more access control devices.

In one or more example methods, determining S112 prioritization data associated with the one or more access control devices comprises determining S112C the prioritization data associated with the one or more access control devices based on the determined pattern.

In one or more example methods, the method 100 comprises detecting S108 the one or more access control devices.

In one or more example methods, the method 100 comprises determining S110 whether there is a new access control device amongst the one or more detected access control devices.

In one or more example methods, the method 100 comprises adding the new access control device to a storage of the electronic device (such as adding or storing the newly detected access control device to the memory circuitry 301, for example to a list of known access control devices) when it is determined that there is a new access control device amongst the one or more detected access control devices.

In one or more example methods, the method 100 comprises stopping (such as pausing, such as ceasing to perform) S113 a detection procedure when it is not determined that there is a new access control device amongst the one or more detected access control devices.

Figure 5:
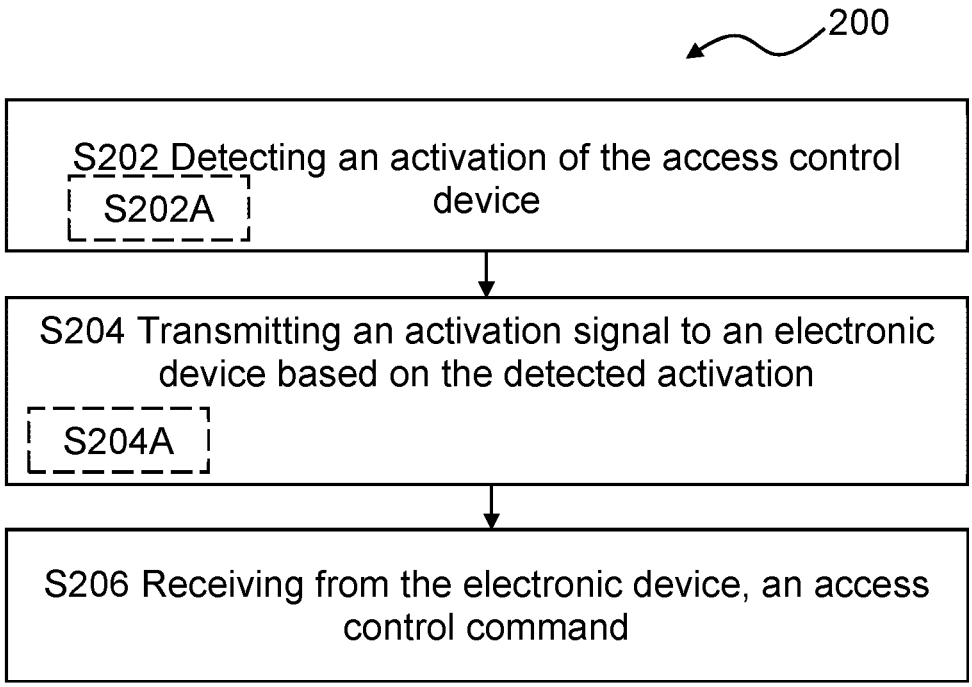
FIG. 5 is a flow-chart illustrating an example method, performed by an access control device, for controlling access to a space according to this disclosure.

FIG. 5 shows a flow-chart illustrating an example method 200 performed by an access control device (such as the access control device disclosed herein, such as access control device 400 of FIG. 3), for controlling access to a space.

The method 200 comprises detecting S202 an activation of the access control device.

The method 200 comprises transmitting S204 an activation signal to an electronic device based on the detected activation.

The method 200 comprises receiving S206 from the electronic device, an access control command.

In one or more example methods, the method 200 comprises detecting S202 an activation of the access control device comprises detecting S202A the activation using a sensor device and/or an activation button.

In one or more example methods, the method 200 comprises transmitting S204 an activation signal to an electronic device based on the detected activation comprises transmitting S204A the activation signal to the electronic device using a short-range wireless communication system and/or an optical communication system.

Embodiments of methods and products (electronic devices and access control devices) according to the disclosure are set out in the following items:

Item 1. An electronic device (300) configured to communicate with one or more access control devices, the electronic device comprising:
a memory circuitry (301);
an interface circuitry (303); and
a processor circuitry (302);
wherein the processor circuitry (302) is configured to:
determine prioritization data associated with the one or more access control devices; and
control, based on the prioritization data, at least one of the one or more access control devices.

Item 2. The electronic device according to item 1, wherein the processor circuitry (302) is configured to:
determine at least one proximity parameter related to a difference in physical locations between the electronic device and at least one of the one or more access control devices and
determine the prioritization data associated with the one or more access control devices based on the determined at least one proximity parameter.

Item 3. The electronic device according to item 2, wherein the processor circuitry (302) is configured to determine the at least one proximity parameter based on a wireless measurement parameter of an activation signal received from the at least one of the one or more access control devices.

Item 4. The electronic device according to item 3, wherein the wireless measurement parameter comprises one or more of: a received activation signal strength parameter, a activation signal quality parameter, an angular measurement parameter, and a time of arrival parameter.

Item 5. The electronic device according to any of items 3-4, wherein the activation signal received from the at least one of the one or more access control device for the wireless measurement parameter is received using a short-range wireless communication system and/or an optical communication system.

Item 6. The electronic device according to any of the previous items, wherein the processor circuitry (302) is configured to:
obtain permission data associated with the at least one of the one or more access control devices, and
determine the prioritization data associated with the one or more access control devices based on the permission data obtained.

Item 7. The electronic device according to any of the previous items, wherein the processor circuitry (302) is configured to:
determine a pattern associated with the at least one of the one or more access control devices, and
determine the prioritization data associated with the one or more access control devices based on the determined pattern.

Item 8. The electronic device according to any of the previous items, wherein the processor circuitry (302) is configured to:
detect the one or more access control devices; and
determine whether there is a new access control device amongst the one or more detected access control devices.

Item 9. An access control device (400) comprising:
a memory circuitry (401);
an interface circuitry (403); and
a processor circuitry (402) being configured to:
detect an activation of the access control device;
transmit an activation signal to an electronic device (300) based on the detected activation; and
receive, from the electronic device (300), an access control command.

Item 10. The access control device (400) according to item 9, wherein the processor circuitry (402) is configured to detect the activation using a sensor device and/or an activation button.

Item 11. The access control device (400) according to any of items 9-10, wherein the access control device is configured to transmit the activation signal to the electronic device using a short-range wireless communication system and/or an optical communication system.

Item 12. A method, performed by an electronic device, for controlling one or more access control devices, the method comprising:
determining (S112) prioritization data associated with the one or more access control devices; and
controlling (S114) based on the prioritization data, at least one of the one or more access control devices.

Item 13. The method according to item 12, the method comprising:

determining (S102) at least one proximity parameter related to a difference in physical locations between the electronic device and at least one of the one or more access control devices and determining (S112) prioritization data associated with the one or more access control devices comprises determining (S112A) the prioritization data associated with the one or more access control devices based on the determined at least one proximity parameter.

Item 14. The method according to item 13, wherein determining (S102) at least one proximity parameter related to a difference in physical locations between the electronic device and at least one of the one or more access control devices comprises determining (S102A) the proximity parameter based on a wireless measurement parameter of an activation signal received from the at least one of the one or more access control devices.

Item 15. The method according to item 14, wherein the wireless measurement parameter comprises one or more of: a received activation signal strength parameter, an activation signal quality parameter, an angular measurement parameter, and a time of arrival parameter.

Item 16. The method according to any of items 14-15, wherein the activation signal received from the at least one of the one or more access control device for the wireless measurement parameter is received using a short-range wireless communication system and/or an optical communication system.

Item 17. The method according to any of items 12-16, the method comprising:

obtaining (S104) permission data associated with the at least one of the one or more access control devices, and determining (S112) prioritization data associated with the one or more access control devices comprises determining (S112B) the prioritization data of the one or more access control devices based on the permission data obtained.

Item 18. The method according to any of items 12-17, the method comprising:

determining (S106) a pattern associated with the at least one of the one or more access control devices, and determining (S112) prioritization data associated with the one or more access control devices comprises determining (S112C) the prioritization data associated with the one or more access control devices based on the determined pattern.

Item 19. The method according to any of items 12-18, the method comprising:

detecting (S108) the one or more access control devices; and determining (S110) whether there is a new access control device amongst the one or more detected access control devices.

Item 20. A method, performed by an access control device, for controlling access to a space, the method comprising:

detecting (S202) an activation of the access control device;

transmitting (S204) an activation signal to an electronic device based on the detected activation; and receiving (S206) from the electronic device, an access control command.

Item 21. The method according to item 20, wherein detecting (S202) an activation of the access control device comprises detecting (S202A) the activation using a sensor device and/or an activation button.

Item 22. The method according to any of items 20-21, wherein transmitting (S204) an activation signal to an electronic device based on the detected activation comprises transmitting (S204A) the activation signal to the electronic device using a short-range wireless communication system and/or an optical communication system.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering. Furthermore, the labelling of a first element does not imply the presence of a second element and vice versa.

It may be appreciated that FIGS. 1A-5 comprises some circuitries or operations which are illustrated with a solid line and some circuitries or operations which are illustrated with a dashed line. The circuitries or operations which are comprised in a solid line are circuitries or operations which are comprised in the broadest example embodiment. The circuitries or operations which are comprised in a dashed line are example embodiments which may be comprised in, or a part of, or are further circuitries or operations which may be taken in addition to the circuitries or operations of the solid line example embodiments. It should be appreciated that these operations need not be performed in order presented. Furthermore, it should be appreciated that not all of the operations need to be performed. The example operations may be performed in any order and in any combination.

It is to be noted that the word "comprising" does not necessarily exclude the presence of other elements or steps than those listed.

It is to be noted that the words "a" or "an" preceding an element do not exclude the presence of a plurality of such elements.

It should further be noted that any reference signs do not limit the scope of the claims, that the example embodiments may be implemented at least in part by means of both hardware and software, and that several "means", "units" or "devices" may be represented by the same item of hardware.

The various example methods, devices, nodes and systems described herein are described in the general context of method steps or processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program circuitries may include routines, programs, objects, components, data structures, etc. that perform specified tasks or implement specific abstract data types. Computer-executable instructions, associated data structures, and program circuitries represent examples of program code for executing steps of the methods disclosed herein. The particular sequence of such executable instructions or associated data structures represents examples of corresponding acts for implementing the functions described in such steps or processes.

Although features have been shown and described, it will be understood that they are not intended to limit the claimed disclosure, and it will be made obvious to those skilled in the art that various changes and modifications may be made without departing from the scope of the claimed disclosure. The specification and drawings are, accordingly, to be regarded in an illustrative rather than restrictive sense. The claimed disclosure is intended to cover all alternatives, modifications, and equivalents.

What is claimed is:

1. An electronic device configured to communicate with one or more access control devices, the electronic device comprising:

a processor circuitry configured to:

obtain permission data associated with the at least one of the one or more access control devices;

determine a pattern associated with the at least one of the one or more access control devices, wherein the pattern is based on a routine of controlling a series of one or more other access control devices;

determine, based on the permission data obtained and the determined pattern, prioritization data associated with the one or more access control devices and indicative of an order or priority of the one or more access control devices; and control, based on the prioritization data, at least one of the one or more access control devices.

2. The electronic device according to claim 1, wherein the processor circuitry is configured to:

determine at least one proximity parameter related to a difference in physical locations between the electronic device and at least one of the one or more access control devices and determine the prioritization data associated with the one or more access control devices based on the determined at least one proximity parameter.

3. The electronic device according to claim 2, wherein the processor circuitry is configured to determine the at least one proximity parameter based on a wireless measurement parameter of an activation signal received from the at least one of the one or more access control devices.

4. The electronic device according to claim 3, wherein the wireless measurement parameter comprises one or more of: a received activation signal strength parameter, a activation signal quality parameter, an angular measurement parameter, and a time of arrival parameter.

5. The electronic device according to claim 3, wherein the activation signal received from the at least one of the one or more access control device for the wireless measurement parameter is received using a short-range wireless communication system and/or an optical communication system.

6. The electronic device according to claim 1, wherein the processor circuitry is configured to:

detect the one or more access control devices; and determine whether there is a new access control device amongst the one or more detected access control devices.

7. The electronic device of claim 1, wherein the processor circuitry is configured to control the at least one of the one or more access control devices while otherwise maintaining the electronic device in a locked state.

8. A method, performed by an electronic device, for controlling one or more access control devices, the method comprising:

obtaining permission data associated with the at least one of the one or more access control devices;

determining a pattern associated with the at least one of the one or more access control devices, wherein the pattern is based on a routine of controlling a series of one or more other access control devices;

determining, based on the permission data obtained and the determined pattern, prioritization data associated with the one or more access control devices and indicative of an order or priority of the one or more access control devices; and controlling based on the prioritization data, at least one of the one or more access control devices.

9. The method according to claim 8, the method comprising:

determining at least one proximity parameter related to a difference in physical locations between the electronic device and at least one of the one or more access control devices and determining prioritization data associated with the one or more access control devices comprises determining the prioritization data associated with the one or more access control devices based on the determined at least one proximity parameter.

10. The method according to claim 9, wherein determining at least one proximity parameter related to a difference in physical locations between the electronic device and at least one of the one or more access control devices comprises determining the proximity parameter based on a wireless measurement parameter of an activation signal received from the at least one of the one or more access control devices.

11. The method according to claim 10, wherein the wireless measurement parameter comprises one or more of: a received activation signal strength parameter, an activation signal quality parameter, an angular measurement parameter, and a time of arrival parameter.

12. The method according to claim 10, wherein the activation signal received from the at least one of the one or more access control device for the wireless measurement parameter is received using a short-range wireless communication system and/or an optical communication system.

13. The method according to claim 8, the method comprising:

determining a pattern associated with the at least one of the one or more access control devices, and determining prioritization data associated with the one or more access control devices comprises determining the prioritization data associated with the one or more access control devices based on the determined pattern.

14. The method according to claim 8, the method comprising:

detecting the one or more access control devices; and determining whether there is a new access control device amongst the one or more detected access control devices.

15. The method of claim 8, wherein controlling the at least one of the one or more access control devices is performed while otherwise maintaining the electronic device in a locked state.

16. An electronic device configured to communicate with one or more access control devices, the electronic device comprising:

a memory circuitry;

an interface circuitry; and a processor circuitry;

wherein the processor circuitry is configured to:

obtain permission data associated with the at least one of the one or more access control devices;

determine a pattern associated with the at least one of the one or more access control devices, wherein the pattern is based on a routine of controlling a series of one or more other access control devices;

determine, based on the permission data obtained and the determined pattern, prioritization data associated with the one or more access control devices and indicative of an order or priority of the one or more access control devices; and control, based on the prioritization data, at least one of the one or more access control devices.

17. The electronic device of claim 16, wherein the processor circuitry is configured to control the at least one of the one or more access control devices while otherwise maintaining the electronic device in a locked state.

* * * * *